US012207747B2

(12) United States Patent
Perez Friscia et al.

(10) Patent No.: US 12,207,747 B2
(45) Date of Patent: Jan. 28, 2025

(54) MAILBOX WITH ATTACHMENTS

(71) Applicants: Lisa Perez Friscia, Franklin Lakes, NJ (US); Matthew Friscia, Franklin Lakes, NJ (US)

(72) Inventors: Lisa Perez Friscia, Franklin Lakes, NJ (US); Matthew Friscia, Franklin Lakes, NJ (US)

( * ) Notice: Subject to any disclaimer, the term of this patent is extended or adjusted under 35 U.S.C. 154(b) by 0 days.

(21) Appl. No.: 17/978,607

(22) Filed: Nov. 1, 2022

(65) Prior Publication Data

US 2024/0138605 A1 May 2, 2024

Related U.S. Application Data

(63) Continuation of application No. 16/268,867, filed on Feb. 6, 2019, now Pat. No. 11,484,142.

(51) Int. Cl.
*A47G 29/122* (2006.01)
*A47G 29/12* (2006.01)
*A47G 29/16* (2006.01)

(52) U.S. Cl.
CPC ..... *A47G 29/122* (2013.01); *A47G 29/1216* (2013.01); *A47G 29/16* (2013.01); *A47G 2200/08* (2013.01)

(58) Field of Classification Search
CPC .. A47G 29/122; A47G 29/1216; A47G 29/16; A47G 29/1209; A47G 2200/08; F21S 9/032; G09F 7/20; F21V 33/00
See application file for complete search history.

(56) References Cited

U.S. PATENT DOCUMENTS 1,358,322 A * 11/1920 Mcintosh ..... A47G 29/1216 248/219.3
4,416,414 A * 11/1983 Edgerton ..... E01H 10/002 232/1 C
4,453,685 A * 6/1984 McMurray ..... A47G 29/1216 232/39
D324,444 S * 3/1992 Cummings ..... D99/31
5,460,326 A * 10/1995 Albanesius ..... A47G 29/1216 232/39
D385,682 S * 10/1997 Erwin ..... D99/31
D385,683 S * 10/1997 Duane ..... D99/29
6,296,180 B1 * 10/2001 Blizzard ..... A47G 29/1209 232/38
6,299,325 B1 * 10/2001 Cathel ..... G09F 13/04 362/183
6,513,284 B1 * 2/2003 Sandlin ..... E01F 9/623 40/607.01
6,662,997 B1 * 12/2003 Smith ..... A47G 29/1216 232/29
6,708,876 B1 * 3/2004 Shirah ..... G09F 7/10 232/38

(Continued)

OTHER PUBLICATIONS

Office Action mailed Apr. 21, 2020, issued in connection with U.S. Appl. No. 16/268,867 (9 pages).

(Continued)

*Primary Examiner* — William L Miller
(74) *Attorney, Agent, or Firm* — McCarter & English, LLP

(57) ABSTRACT

A mailbox with components which can be connected to or disconnected from the mailbox for adding or changing functional or ornamental aspects of the mailbox.

6 Claims, 10 Drawing Sheets

(56) References Cited

U.S. PATENT DOCUMENTS

| | | | | |
|---|---|---|---|---|
| 6,974,073 | B1 * | 12/2005 | Snyder | A47G 29/1203 232/29 |
| 7,350,692 | B2 * | 4/2008 | Bushee | A47G 29/1212 232/38 |
| 8,631,998 | B1 * | 1/2014 | Connelly | G09F 15/00 40/566 |
| 9,700,167 | B1 * | 7/2017 | Nordberg | A47G 29/1216 |
| D805,719 | S * | 12/2017 | Kelly | D99/33 |
| 9,980,593 | B2 * | 5/2018 | Pajonas | A47G 29/1216 |
| 10,028,606 | B1 * | 7/2018 | Ritchie | G07C 9/00912 |
| 10,113,729 | B2 * | 10/2018 | Knabe | A47G 29/1209 |
| 10,960,988 | B2 * | 3/2021 | Walker | B64F 1/02 |
| 11,484,142 | B2 | 11/2022 | Perez Friscia et al. | |
| 2008/0257947 | A1 * | 10/2008 | Guo | A47G 29/122 232/38 |
| 2014/0104819 | A1 * | 4/2014 | Dowding | A47G 29/122 362/183 |
| 2016/0033966 | A1 * | 2/2016 | Farris | A47G 29/30 701/16 |
| 2016/0235236 | A1 * | 8/2016 | Byers | A47G 29/14 |
| 2017/0016605 | A1 * | 1/2017 | Knabe | A47G 29/122 |
| 2018/0049575 | A1 * | 2/2018 | Yamrick | A47G 29/141 |
| 2018/0225628 | A1 * | 8/2018 | Roy | B64C 39/024 |
| 2018/0357910 | A1 * | 12/2018 | Hobbs | G05D 1/0676 |
| 2019/0217971 | A1 * | 7/2019 | Comerford | B64C 39/024 |
| 2019/0300202 | A1 * | 10/2019 | High | G06Q 10/08 |
| 2020/0245798 | A1 | 8/2020 | Perez Friscia et al. | |

OTHER PUBLICATIONS

Office Action mailed Jan. 27, 2021, issued in connection with U.S. Appl. No. 16/268,867 (9 pages).
Office Action mailed Apr. 27, 2021, issued in connection with U.S. Appl. No. 16/268,867 (8 pages).
Office Action mailed Oct. 28, 2021, issued in connection with U.S. Appl. No. 16/268,867 (9 pages).
CoApplicant-Initiated Interview Summary mailed Mar. 17, 2022, issued in connection with U.S. Appl. No. 16/268,867 (3 pages).
Examiner-Initiated Interview Summary dated Apr. 14, 2022, issued in connection with U.S. Appl. No. 16/268,867 (1 page).
Advisory Action mailed Apr. 15, 2022, issued in connection with U.S. Appl. No. 16/268,867 (4 pages).
Examiner-Initiated Interview Summary dated Sep. 16, 2022, issued in connection with U.S. Appl. No. 16/268,867 (1 page).
Notice of Allowance dated Sep. 20, 2022, issued in connection with U.S. Appl. No. 16/268,867 (8 pages).

* cited by examiner

MAILBOX WITH ATTACHMENTS

CROSS-REFERENCE TO RELATED APPLICATIONS

The present application is a continuation of U.S. patent application Ser. No. 16/268,867 filed on Feb. 6, 2019, now U.S. Pat. No. 11,484,142 issued on Nov. 1, 2022, the entire disclosure of which is expressly incorporated herein by reference.

BACKGROUND

Field

The present disclosure generally relates to a mailbox that can be customized by adding or removing attachment components for decorative or functional uses.

Related Art

Mailboxes or generally purchased, installed and used without any change in structure or appearance. Conventional mailboxes are not known to allow for changes in the appearance, structure or functionality after the mailbox is purchased, installed and/or used.

SUMMARY

A mailbox is disclosed, and more particularly, a mailbox with components which can be connected to, or disconnected from, the mailbox for adding or changing functional or ornamental aspects of the mailbox. A mailbox may include a mailbox, mailbox base and support post and can include one or more attachments, including, but not limited to, shelves, planters, receptacles, birth baths, banners, signs, flags/banners, house numbers, lighting, etc. The attachments can be interconnected with the mailbox, mailbox base or support post in various ways.

BRIEF DESCRIPTION OF THE DRAWINGS

The foregoing features will be apparent from the following Detailed Description, taken in connection with the accompanying drawings, in which.

DETAILED DESCRIPTION

Figure 1:
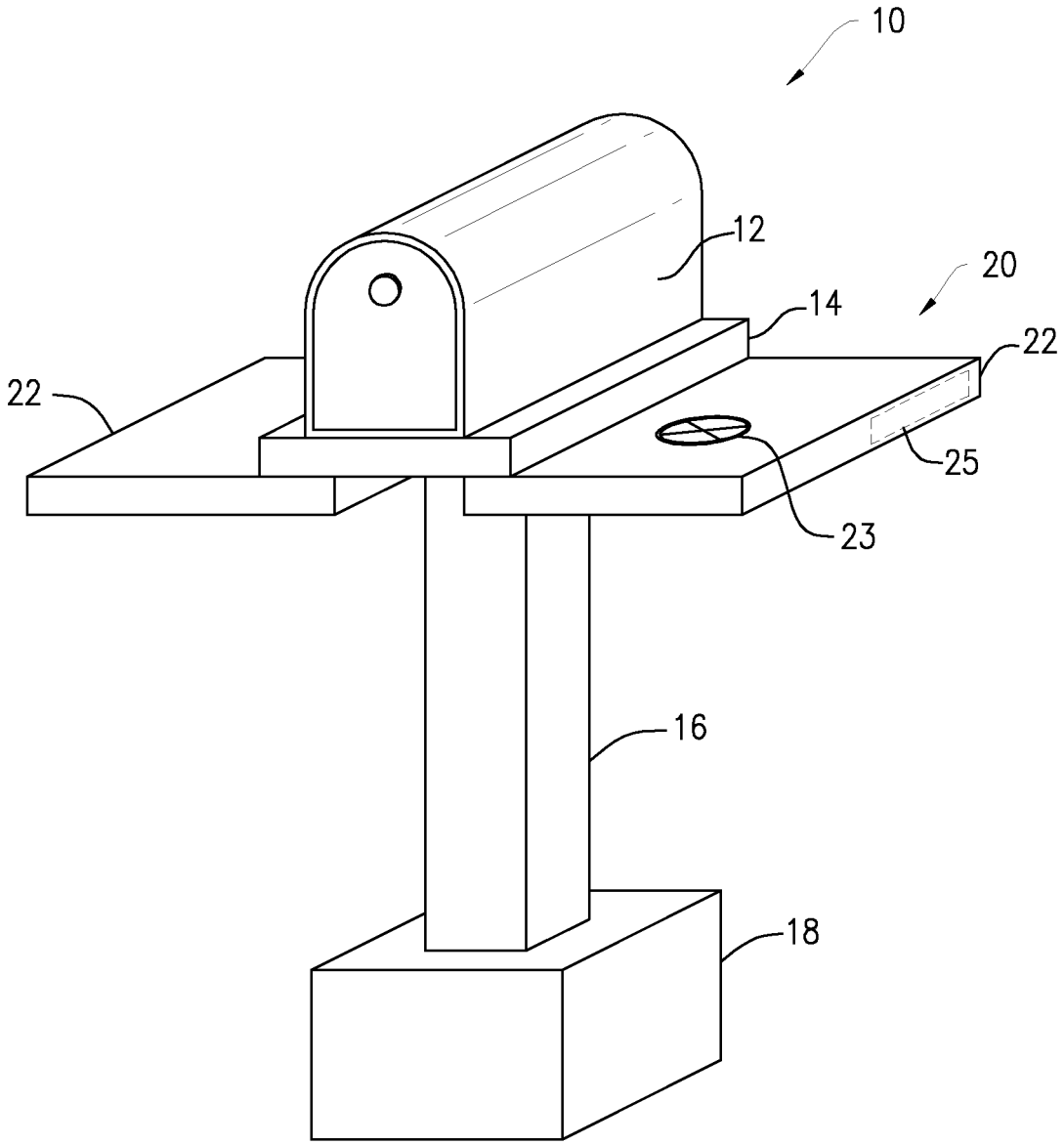
FIG. 1 is a perspective view of a mailbox with shelves.

FIG. 1 shows a mailbox 10, having a mailbox bin 12, a mailbox base 14 and a support post 16. The mailbox 10 includes a mailbox bin 12, and a mailbox door 11, and may include a mailbox base 14 and a support post 16. The support post 16 could be sunk into the ground, cemented in position, or otherwise positioned to support a mailbox bin 12 at an appropriate height and location for use. The post 16 can have a post base 18. The mailbox bin 12, as well as any other mailbox discussed herein, can be attached to the top of a post 16 or alongside a post 16. The mailbox 10, as well as any other mailbox discussed herein, can also have a mailbox bin 12 that is attached to another support, such as a surface of a wall of a house or at another location, or the mailbox could be on or in a support post or support column, i.e. a brick pillar located along a driveway. The mailbox 10 and the mailbox bin 12, as well as the other mailboxes discussed herein, can take on any suitable configuration for receiving mail.

Figure 2:
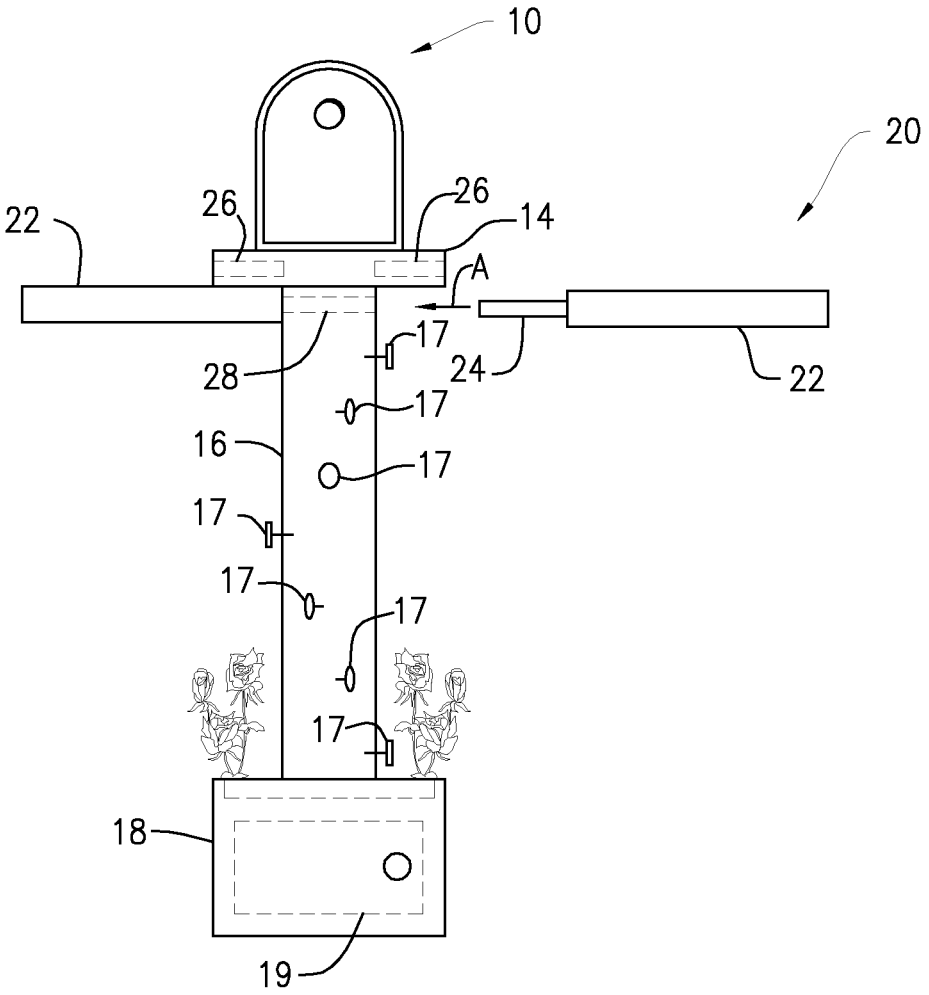
FIG. 2 is a front view of the mailbox shown in FIG. 1 with one shelf connected to a post, and a separate, unattached shelf.
Figure 3:
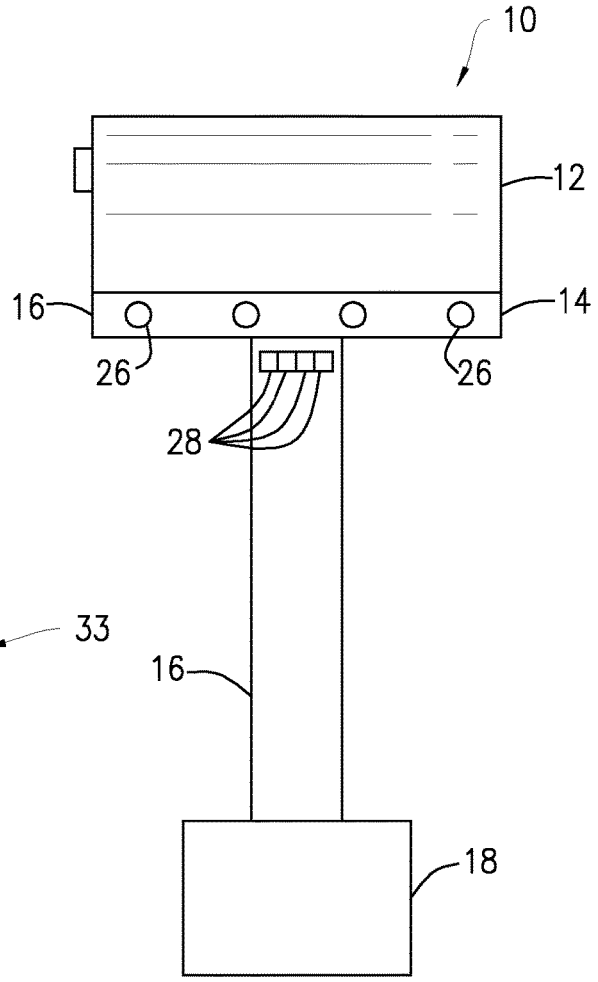
FIG. 3 is a side view of a mailbox.

The mailbox 10 is configured for the attachment of one or more auxiliary components, or attachments, for extending the functionality or ornamentality of the mailbox. As can be seen in FIGS. 1-3, components can be attached to the mailbox 10 in various ways. FIG. 1 shows mailbox 10 with auxiliary components 20 in the nature of shelves 22 positioned alongside mailbox 10. The shelves 22 can be connected to the mailbox base 14, the post 16 or other location proximate mailbox 10. In FIG. 1, the shelves 22 are shown attached to the post 16. The shelves 22 can be used to receive and support packages, newspapers or the like, or can be used to support other items. A shelf 22 could include a target 23, that could be perceived optically or electronically by a drone delivering packages, indicating a package delivery location. Signal or beacon electronics 25 associated with the shelf could also be provided to assist with automatic package delivery. The beacon could use known communication protocols, such as wifi, rfid, near field communications or the like to communicate with a drone to provide for automatic package delivery.

As shown in FIGS. 2 and 3 auxiliary components 20 can be attached to the mailbox base 14 or post 16 by one or more pegs or rods 24 extending from component 20 that are sized and shaped for receipt in corresponding receptacles 26 in a mailbox base 14 or corresponding receptacles 28 in a support pole 16, when the pegs 22 are moved in the direction of Arrow A towards the mailbox. Any other suitable configuration for connecting the attachments to the mailbox can be employed. For example, support pegs could extend from the mailbox base 14 or post 16 for receipt in receptacles located in the component attachments. The pegs and receptacles could be cylindrical, rectangular or any other suitable shape. Likewise, other attachment mechanisms could be employed. For example, other attachments could include rods or blocks instead of cylindrical pegs. Straps of metal or another material, such as a woven material or other flexible material could attach component attachments to the mailbox base or support, and interlock such components, instead of receptacles and pegs. Other types of connectors could be used as well, including brackets, hangers, slidable engageable structures, etc., to form a mechanical connection between the attachment component or components and the mailbox 10. Any suitable connectors can be used to attach the components discussed herein with the mailbox, mailbox base, support pole or other structure associated with a mailbox. The mechanical connection could be permanent or configured to allow the attachment components to be removable and replaceable. Also, as shown in FIG. 2, connectors 17 can be provided along the support pole 16 to support streamers, garland, lights and the like. Further, base 18 can include a door 19 that open and closes, and the base can be sized for storage. The upper side of the base can have a compartment 15 for soil and flowers.

Figure 4A:
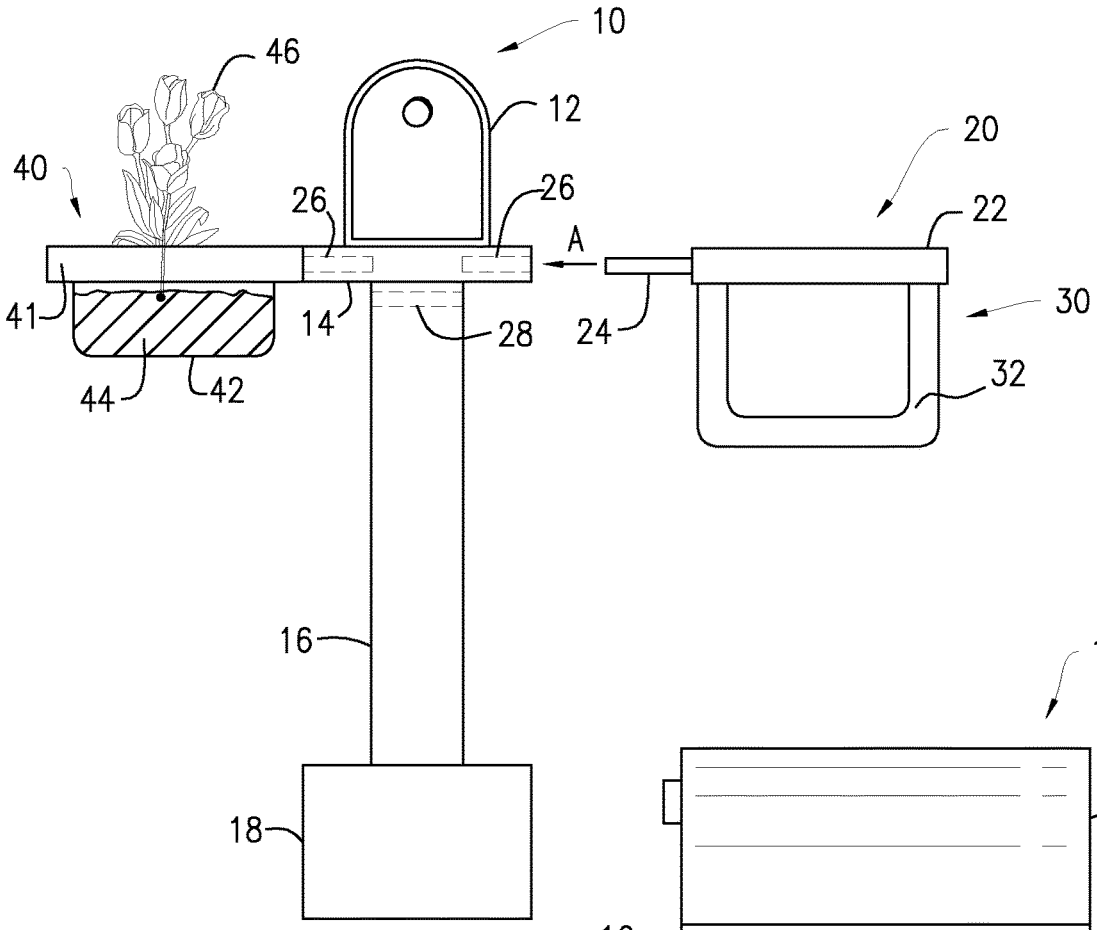
FIG. 4A is a front view of a mailbox with a planter attachment component connected to a mailbox, and a separate, unattached, shelf with a receptacle.
Figure 4B:
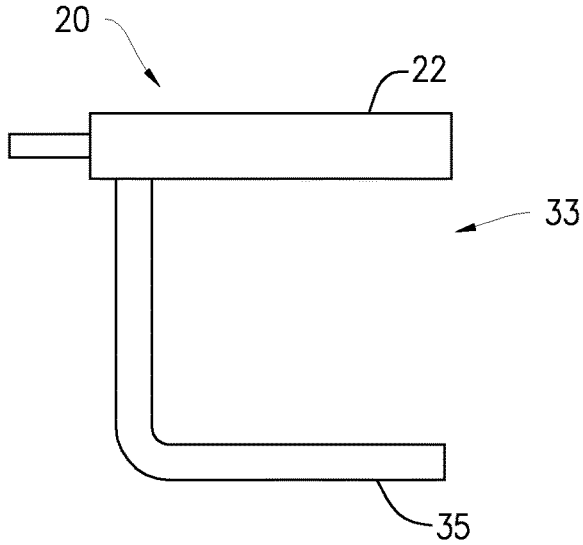
FIG. 4B shows another shelf with a receptacle.

FIG. 4A shows a mailbox 10, having mailbox bin 12, base 14 and post 16 with an attachment component 40 comprising a planter. The planter component 40 attaches to mailbox 10 in any suitable manner such as with attachment pegs 28, for receipt in receptacles 26, 28 in the mailbox base 14 or post 16, respectively, when pegs 24 are moved in the direction of Arrow A. The planter component 40 includes a perimeter 41 supporting a basin 42 that holds soil 44 in which a plant 46 can grow to decorate and provide ornamentality to the mailbox. FIG. 4 also shows an attachment component 20 in the nature of a shelf 22 having a receptacle 30 defined by one or more walls 32 depending from the shelf 22. The receptacle 30 can have an open or closed front or back, and as shown in FIG. 4B, the receptacle 33 side and bottom surface 35 with a second side that can be open to provide a surface under shelf 22 that is generally parallel to shelf 22 and sheltered by shelf 22. The receptacle can receive newspapers, packages, etc.

Figure 5:
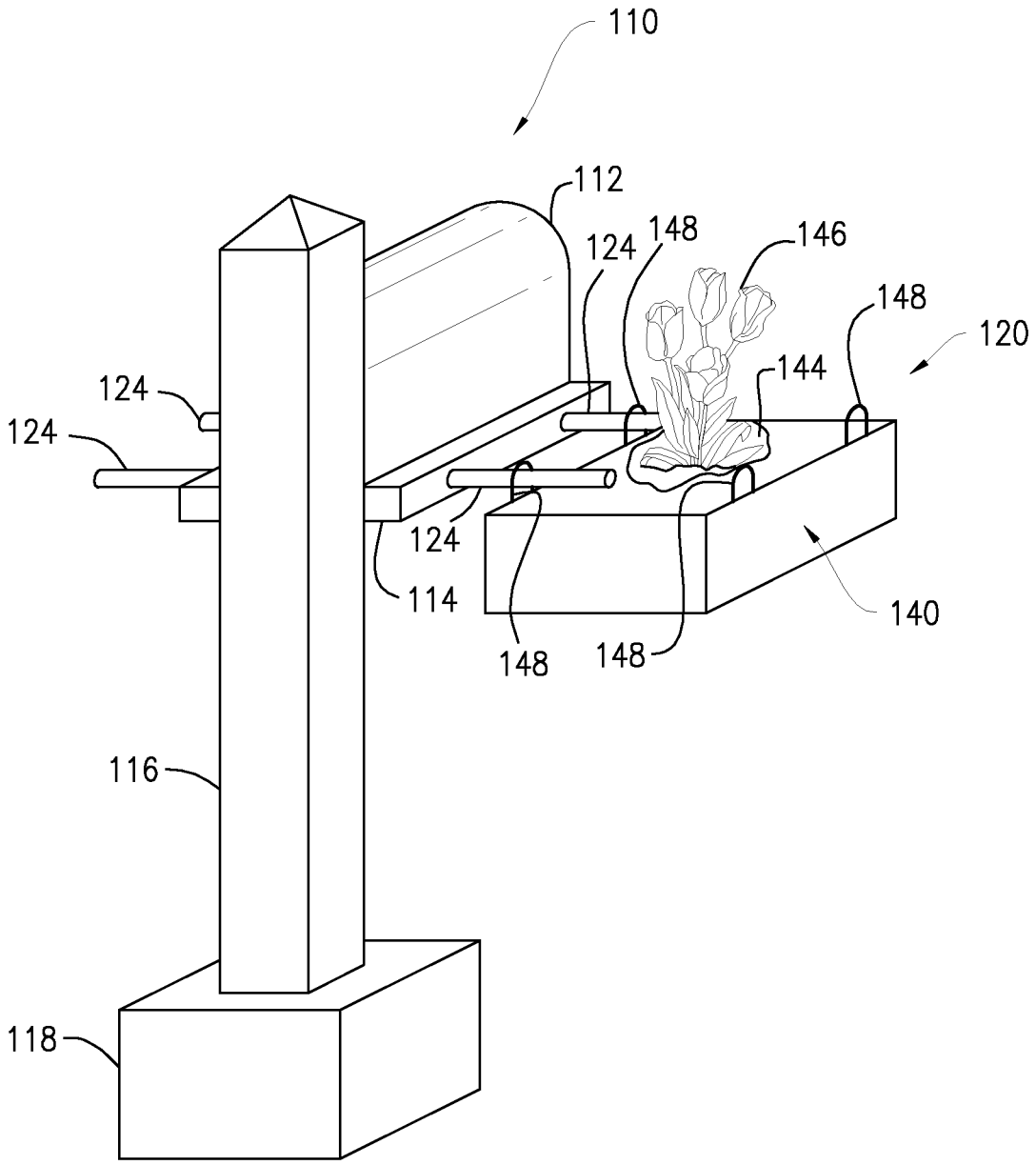
FIG. 5 is a perspective view of a mailbox with another planter attachment component partially connected to a mailbox.

FIG. 5 shows a mailbox 110, having mailbox bin 112 and mailbox base 114 attached alongside a support post 116 having a post base 118. The mailbox base 114 has a plurality of pegs 124 extending therefrom. An attachment component 120 comprises a planter 140 with soil 144 and a plant 146. The planter 140 includes a plurality of loops 148 formed of any suitable material sized and configured to receive pegs 124 extending from the mailbox base 114. Other configurations and methods can be used for connecting planter 140 with mailbox 110.

Figure 6:
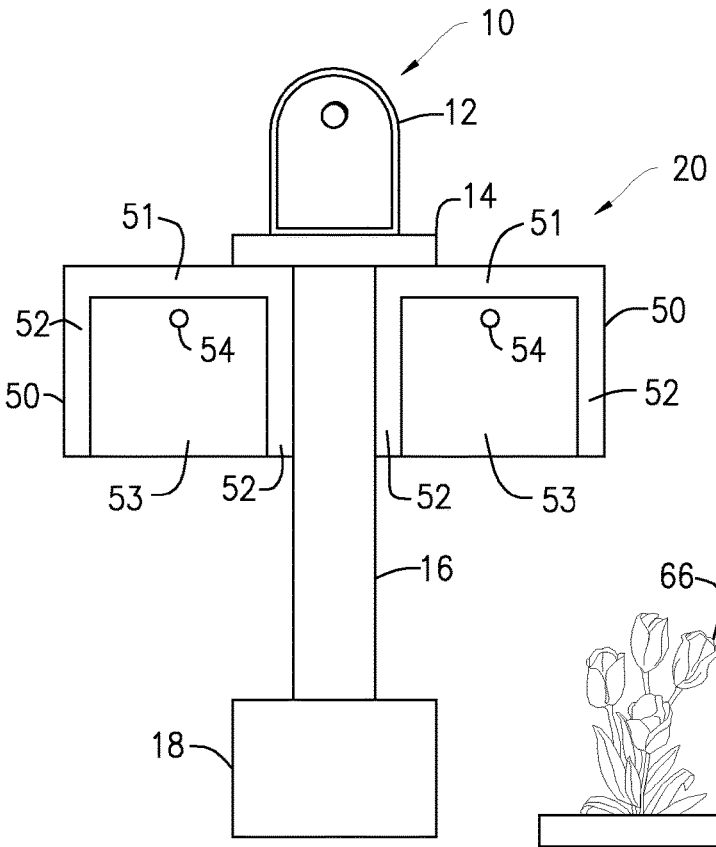
FIG. 6 is a front view of a mailbox with attachment components in the form of bins.

FIG. 6 shows a mailbox 10 with attachment components 20. The attachment components 20 in FIG. 6 comprise auxiliary bins 50 having an upper walls 51, the tops of which form a shelves, depending walls 52 and bottom walls (not shown) with doors 53 having knobs 54, the doors hingedly attached to the bottom walls. The doors 53 can be opened or closed for access to the bins 50 and the bins 50 can be used to receive newspapers or packages or to hold materials. Bins with other configurations, such as bins with doors attached to upper walls, or bins without doors, can be utilized. Bins 50 can be used for storage of things like pet supplies, pet treats, leashes, poop bags, bird seed and the like. The bins 50 can have insulated walls to maintain hot or cold temperature environments for hot or cold food or other items that could be delivered. Further, the mailbox could be provided with electrical service and the bins could include electrically powered heaters or coolers.

Figure 7:
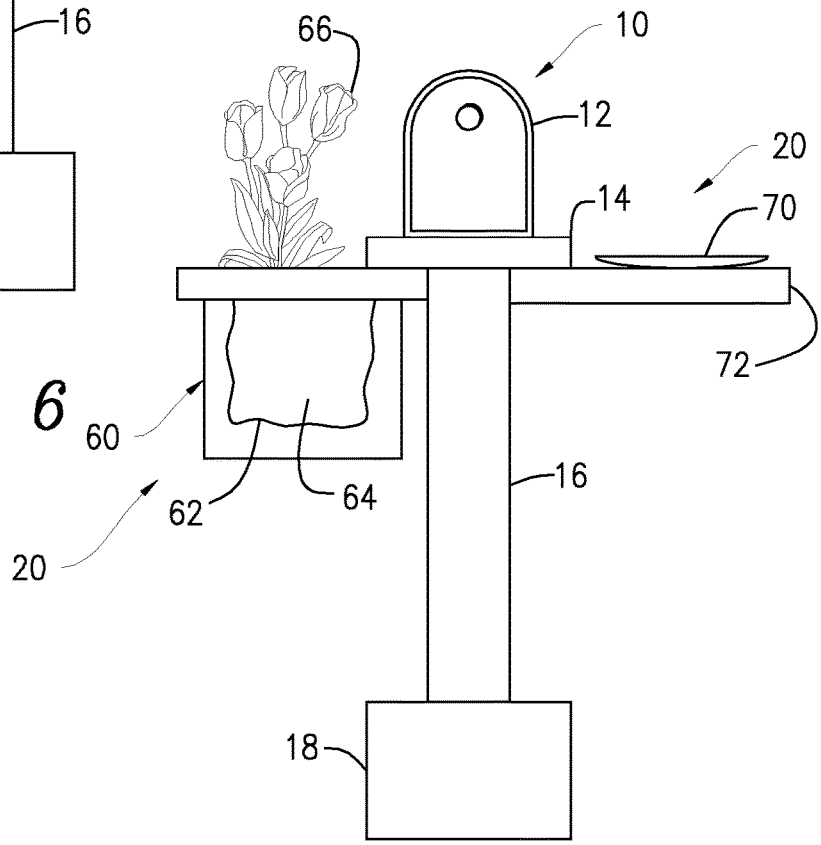
FIG. 7 is a front view of a mailbox with attachment components in the form of a planter and a bird bath.

FIG. 7 shows a mailbox 10 with an attachment component 20 on one side comprising and a planter 60 including a basin 62 holding soil 64 for plant 66. The other attachment component 20 comprises a bird bath having an open water container 70 for holding water for birds, the container sitting on or attached to shelf 72. The container 70 could also be a bird feeder.

Figure 8:
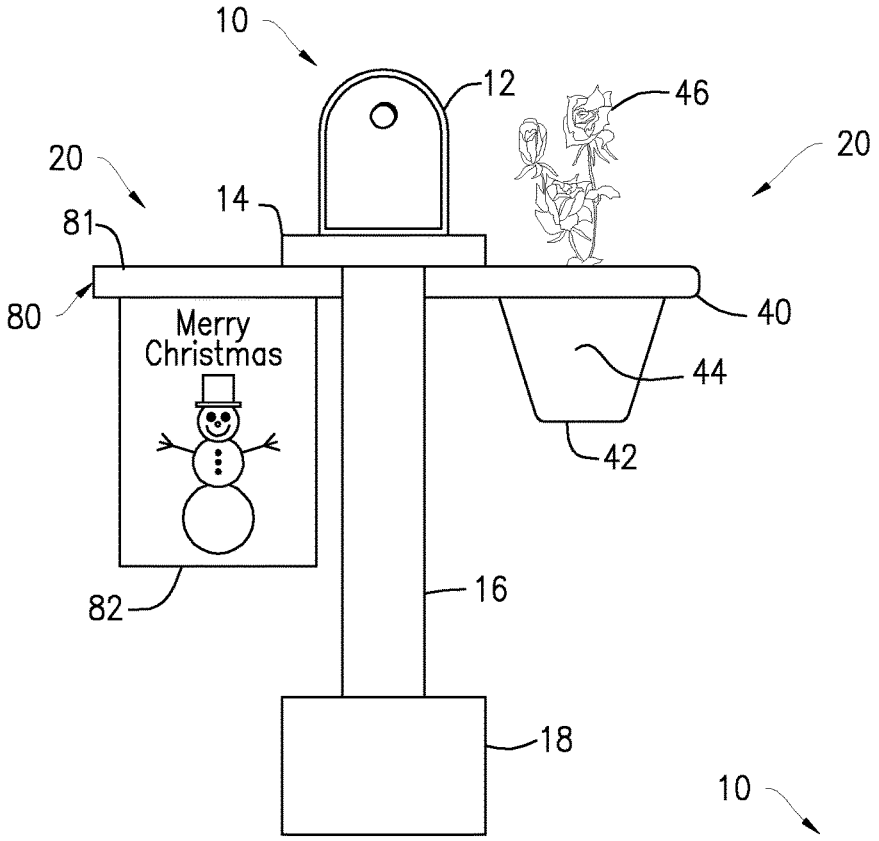
FIG. 8 is a front view of a mailbox with attachment components in the form of a planter and a banner.

FIG. 8 shows a mailbox 10 with an attachment component 20 in the form of a planter 40 with a basin 42 for holding soil 44 for a plant 46. Another attachment component 20 comprises a banner or sign attachment 80 including a banner 82 that can hang from a support arm 81 attached to the mailbox 10. The banner 82 could bear an image or message that could be permanent, seasonal or otherwise. The banner 82 can be affixed to the support arm 81 and the support arm can be removed and replaced with a different banner to display a different image, or the banner could be removeably attached to the support arm, for example, by threading the upper edge of the banner into a recess along a lower portion of the arm. For a seasonal motif, the banner 82 could have a holiday image or message, and the other attachment could have a holiday plant such as a Poinsettia or a small Christmas tree that could be decorated and/or have lights. The mailbox 10 could be provided with electric service and could have outlets to allow for attachments to be plugged-in, through attachment connections, or into outlets and powered. The electric service could be wired alternating current, battery direct current or solar power. The attachment components can be mixed and matched for various occasions. Other attachment components could be developed as desired. A holiday motif could include wreaths, snowflakes, snowmen, etc. Separate arms could be provided on attachment components for hanging wreaths, lights, decorations or the like. Hooks can be provided to hang items like a newspaper bag or other bag or other decorations such as wreathes or lights or garland. Accordingly, mailbox 10 could have two attachment components that are the same, e.g. two decorated Christmas trees. Further, one component could be attached to another component, so that a wreath, or a banner with a wreath shown thereon, could be attached to a mailbox 10, or to another attachment component to provide further decoration and/or functionality. Such attachment of additional components can be made in accordance with the attachment configurations disclosed herein.

Figure 9A:
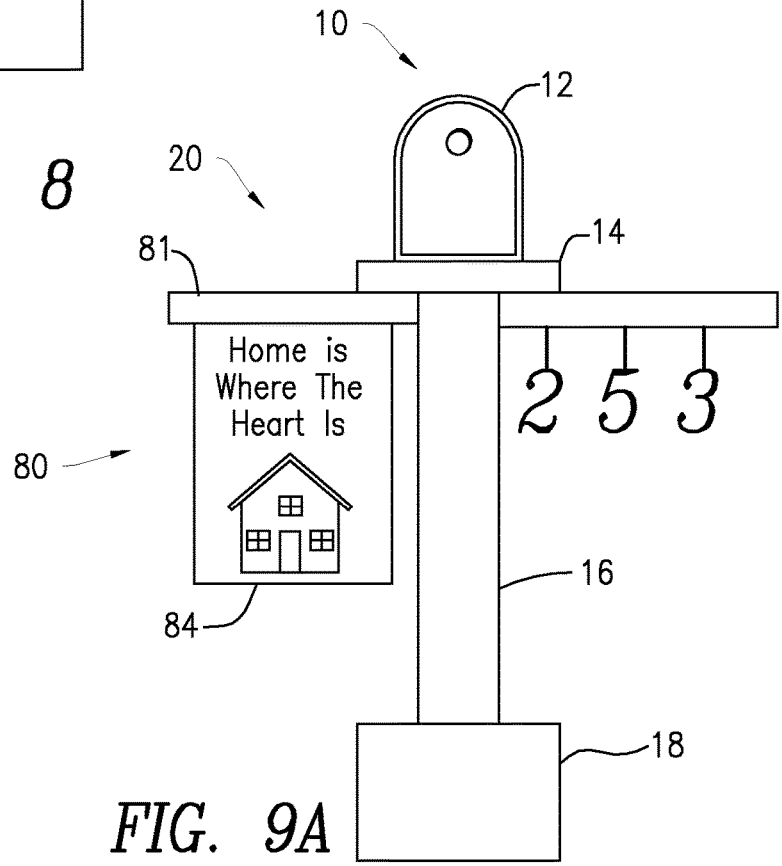
FIGS. 9A, 9B and 9C are front views of mailboxes with attachment components in the form of banner, and signs.
Figure 9B:
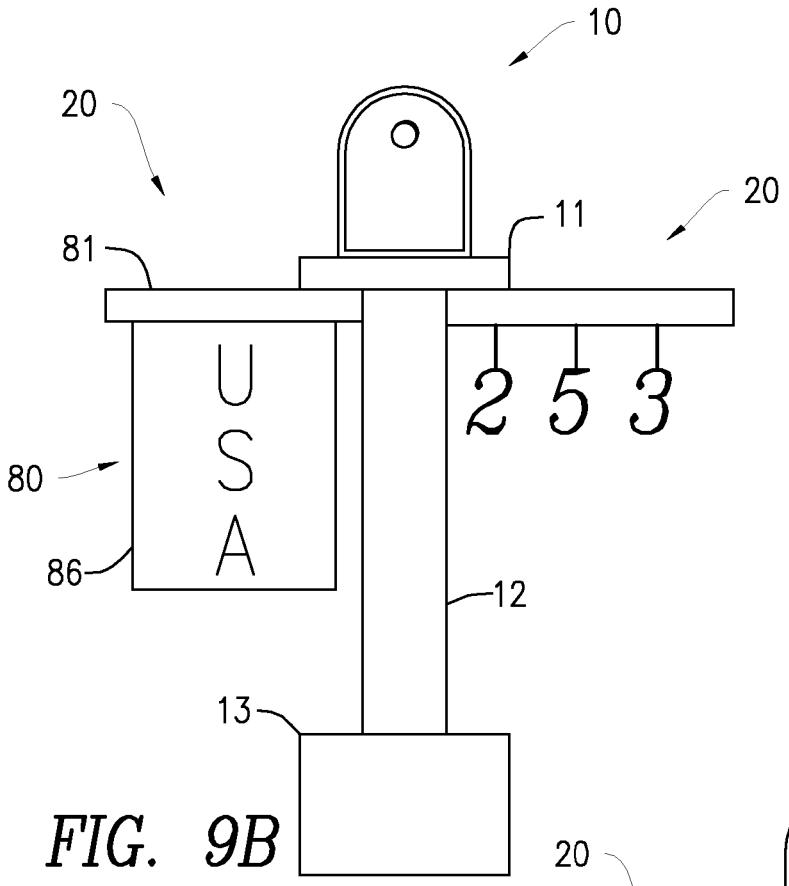
Figure 9C:
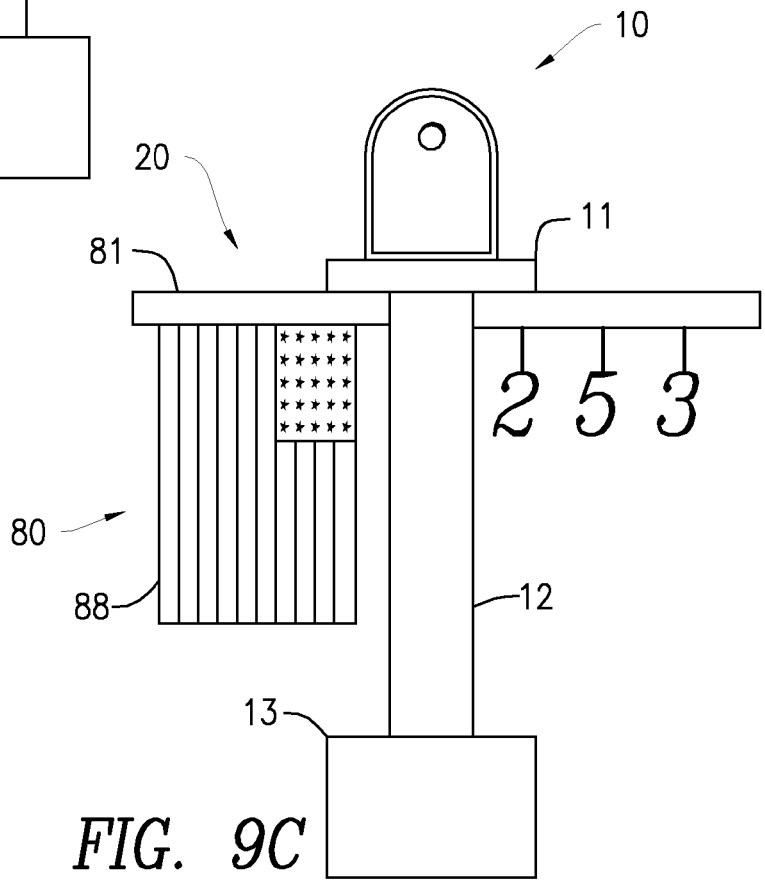

FIGS. 9A, 9B and 9C show mailboxes 10 with attachment components 20 in the form of a banner attachments 80 including banners 84, 86 and 88 all hanging from support arm 81 attached to the mailbox 10. Each banner could be removeably attached to the support arm or each banner could be fixedly attached to its own support arm. Another attachment component 20 comprises a sign and could it could replaceably receive one or more letters, numbers or symbols to create a message. For example, the characters could be attached to supports, the upper ends of which can be received in a slot in support arm 121 to suspend the characters for viewing. As such, a house number, or any other message, or one or more designs, could be displayed.

Figure 10:
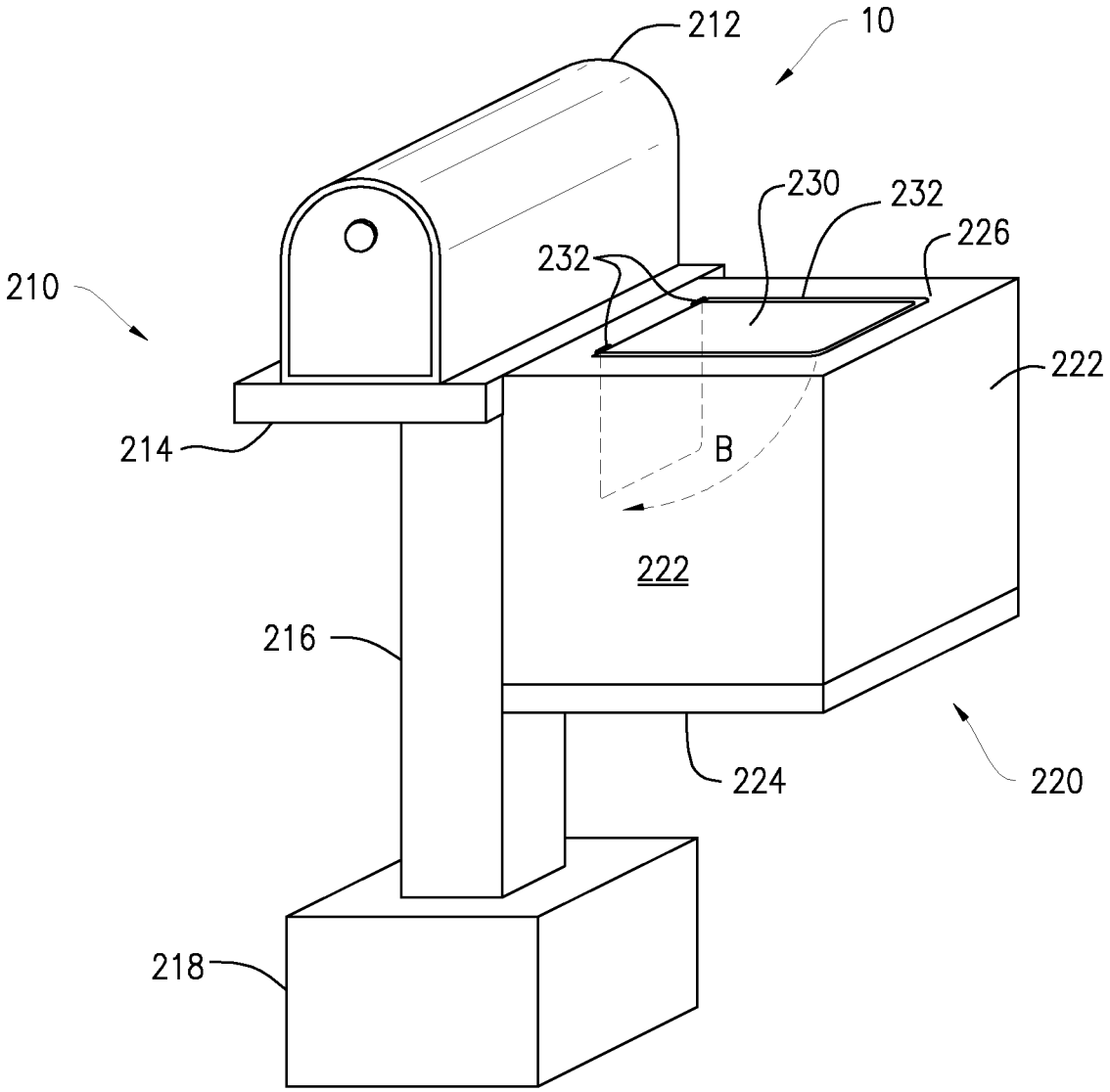
FIG. 10 is a view of a mailbox with a covered receptacle attached to the mailbox for receiving and covering packages.

FIG. 10 shows another mailbox 210 with a covered package receptacle 220 attached thereto. The mailbox 210 has a mailbox bin 212 and mailbox base 214 attached alongside a support post 216 having a post base 218. A receptacle 220 can be attached to the mailbox base 214, as shown, or to the post 216 or other location proximate mailbox 210. The receptacle 220 can include side walls 222, bottom wall 224 and top wall 226 to form an enclosure. Top wall 226 can include a lid 230 attached to the top wall by hinges 232 or the like that bias the lid to a closed position along top wall 226. The lid 230 can pivot in the direction of Arrow B to open and close the receptacle 220. Alternatively, the lid 230 can open in the opposite direction. The lid 230 can be moved manually or automatically. A courier can open the lid 230 and place a package in the receptacle 220. Alternatively, the lid 230 can be electronically opened and closed by activation by a courier, wherein a courier can push a button, or the like, to complete an electrical connection that activates a mechanism to open or close the lid 230. The lid 230 can also be opened for receipt of a package in the receptacle 220 by the weight of a package on the lid to move it open, and it can move back to a closed position after the package is in the receptacle 220 and no longer bearing against the lid 230. The lid 230 can even be open and closed automatically by signal from a drone or the like, using any communication protocol, delivering a package, either directly or by an alert provided from a package delivery service to recipient. The lid 230 can be engaged with the top wall 226 of the receptacle 220 in a water tight configuration to provide a weather-proof receptacle 220 for packages. For example, the lid 230 or top wall 226 or receptacle 220 could have a gasket 232 or the like about a perimeter to seal the receptacle 220 when the lid 230 is in a closed position. The lid 230 could include a target, that could be perceived by a drone delivering packages, indicating a package delivery location. Signal or beacon electronics associated with the receptacle could also be provided to assist with automatic package delivery. The beacon could use known communication protocols, such as wifi, rfid, near field communications or the like to communicate with a drone to provide for automatic package delivery.

Figure 11:
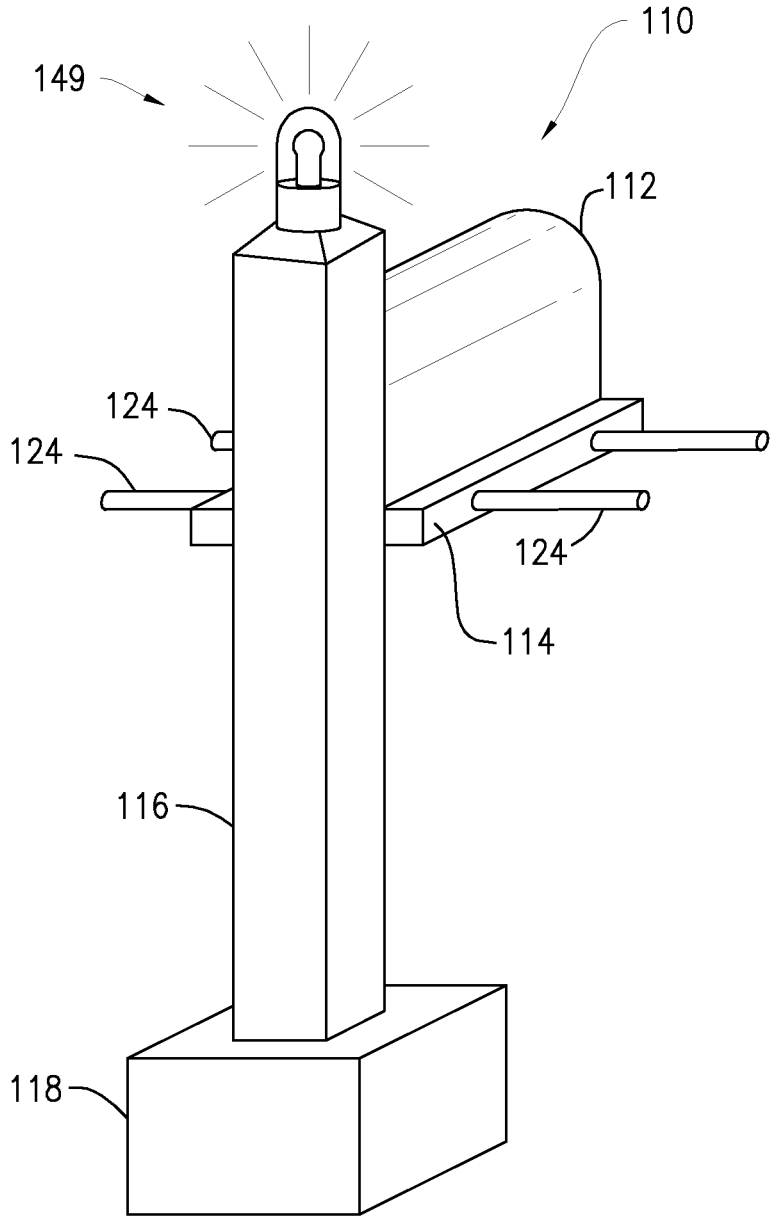
FIG. 11 is a view of a mailbox with a lighting attachment to the mailbox which can be electrically connected or solar power operated.

FIG. 11 is a view of a mailbox with a lighting attachment 49 to the mailbox which can be electrically connected or solar power operated.

Figure 12:
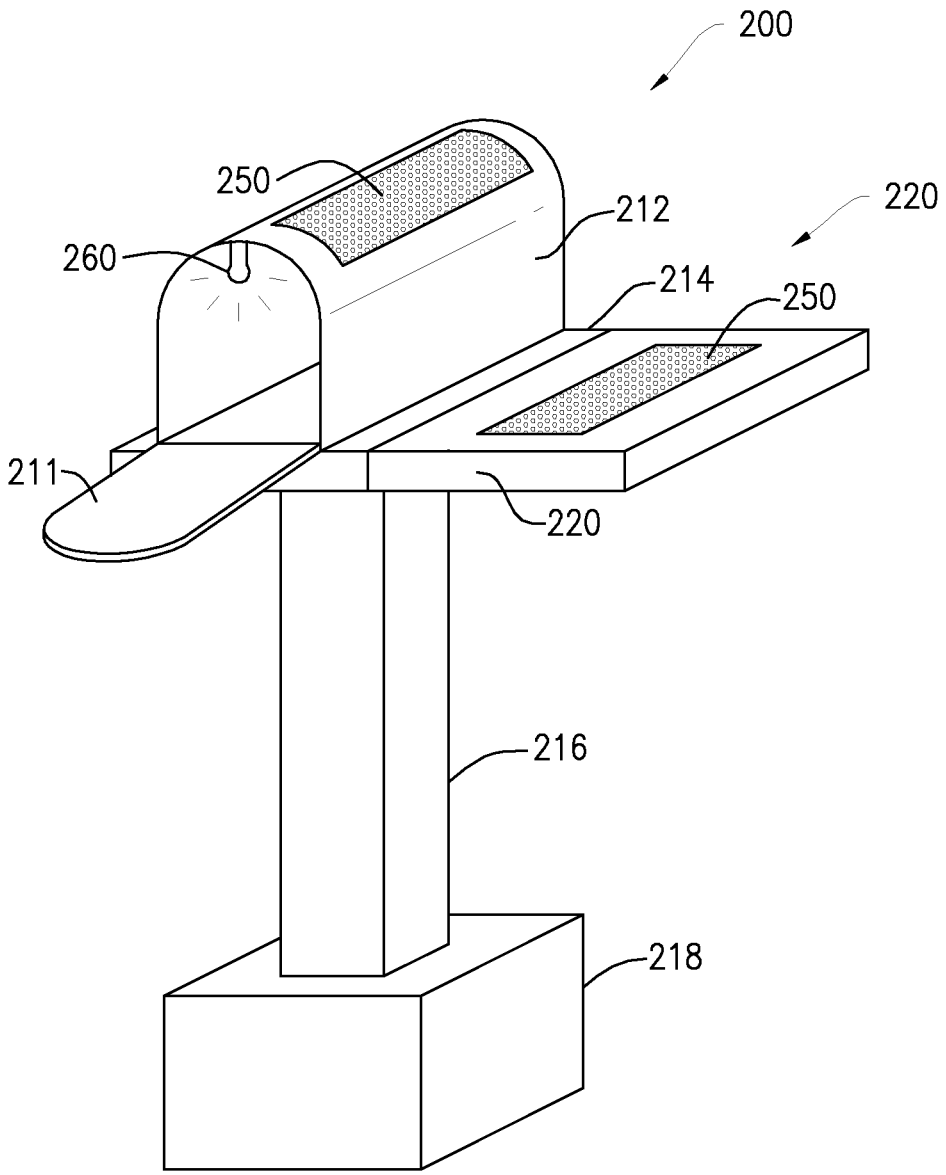
FIG. 12 is a view of an open mailbox with a light inside and one or more solar collectors.

FIG. 12 shows a mailbox 200 including a bin 212 on a base 214. The mailbox can have an internal light 260 which can be wired and can light when the mailbox door 211 is opened. The light could also be a solar powered LED. A solar collector 250 could be positioned on the mailbox, on a shelf 220 attached to the mailbox or in any other suitable location. The solar panel 250 is in electrical communication with the light 260. An internal electrical connection can be made from an attachment, to light, internal of the connection between the attachment and the mailbox. The light 260 can be turned on when the mailbox door is opened, or it can be always on. The light can help one see inside the mailbox when it is dark.

While the invention has been described in detail and with reference to specific examples thereof, it will be apparent to one skilled in the art that various changes and modifications can be made therein without departing from the spirit and scope thereof.

What is claimed is:

1. A modular mailbox comprising:

a support post;

a mailbox attached to the support post and supported at a location by the support post;

one or more attachments comprising one or more shelves removably attached directly to the support post alongside the mailbox to present one or more horizontal surfaces alongside the mailbox;

a solar collector on the one or more shelves; and a light on the mailbox.

2. The mailbox of claim 1 further comprising another solar collector on a top of the mailbox.

3. The mailbox of claim 1 wherein the light is in the mailbox and the light turns on when a door of the mailbox is opened.

4. A modular mailbox comprising:

a support post;

a mailbox support attached to the support post;

a mailbox attached to the mailbox support;

one or more shelves removably attached directly to the sides of the mailbox to present one or more horizontal surfaces alongside the mailbox;

a solar collector on the one or more shelves; and a light on the mailbox.

5. The mailbox of claim 4 further comprising another solar collector on a top of the mailbox.

6. The mailbox of claim 4 wherein the light is in the mailbox and the light turns on when a door of the mailbox is opened.

* * * * *